United States Patent [19]

Natterer et al.

[11] Patent Number: 5,027,578

[45] Date of Patent: Jul. 2, 1991

[54] PACKAGING MACHINE FOR THE PACKAGING OF MATERIALS TO BE DISPOSED

[75] Inventors: Johann Natterer, Legau; German Wankmiller, Ronsberg; Konrad Burghart, Ottobeuren, all of Fed. Rep. of Germany

[73] Assignee: Multivac Sepp Haggenmüller KG, Fed. Rep. of Germany

[21] Appl. No.: 471,589

[22] Filed: Jan. 29, 1990

[30] Foreign Application Priority Data

Feb. 3, 1989 [DE] Fed. Rep. of Germany ..... 3903280

[51] Int. Cl.[5] ..... B65B 31/02; B65B 67/12

[52] U.S. Cl. ..... 53/86; 53/512; 53/527; 53/390

[58] Field of Search ..... 53/86, 79, 512, 510, 53/434, 432, 527, 390; 252/626

[56] References Cited

U.S. PATENT DOCUMENTS

| | | | |
|---|---|---|---|
| 2,833,096 | 5/1958 | Randall | 53/86 |
| 3,866,390 | 2/1975 | Moreland, II et al. | 53/79 |
| 4,078,962 | 3/1978 | Krueger | 53/86 X |
| 4,324,068 | 4/1982 | Yamashita et al. | 53/527 |
| 4,592,192 | 6/1986 | Jacob et al. | 53/512 |
| 4,744,203 | 5/1988 | Brockwell et al. | 53/86 X |
| 4,843,796 | 7/1989 | Furukawa | 53/434 |

FOREIGN PATENT DOCUMENTS

| | | | |
|---|---|---|---|
| 1939216 | 8/1969 | Fed. Rep. of Germany . | |
| 2102890 | 8/1971 | Fed. Rep. of Germany . | |
| 3231221 | 8/1982 | Fed. Rep. of Germany . | |
| 182218 | 7/1989 | Japan | 53/86 |

*Primary Examiner*—James F. Coan

*Attorney, Agent, or Firm*—Lowe, Price, LeBlanc and Becker

[57] ABSTRACT

A packaging machine for the packaging of materials to be disposed comprises a container for receiving an open bag as well as evacuation means and a lid which can be opened and hermetically seals the container from the exterior. In order to avoid a contamination of the lid at the inner side thereof, the bag has a collar and a seam connected thereto. The latter is hooked in supporting bolts of the lid.

14 Claims, 5 Drawing Sheets

PACKAGING MACHINE FOR THE PACKAGING OF MATERIALS TO BE DISPOSED

BACKGROUND OF THE INVENTION

The invention relates to a packaging machine for the packaging of material for disposal. The invention relates in particular to a packaging machine having a container receiving a bag hanging therein and having an open top for entering the material, a lid which may be opened and hermetically seal the interior of the container from the exterior as well as an evacuation installation for evacuation of the interior of the bag and sealing means for closing the bag by means of a cover.

Such a conventional vacuum packaging machine is disclosed in the German Patent Specification No. 3,231,221. This machine has an openable lid disposed above the open top of the bag. On one side of the bag there is a separate film section or a film web which, after filling the bag, can be pulled over the open top of the bag by means of pull chains such that the bag can be closed after having covered the interior of the bag by means of the film pulled thereabove.

The U.S. Pat. No. 3,866,390 discloses a packaging machine comprising a pair of fingers engaging holes provided at the rim of a bag for holding the bag. The U.S. Pat. No. 4,324,088 discloses a refuse storage apparatus, being in particular used for storing kitchen garbage, which has a bag insertable therein, the bag having a bag portion comprising a rim, a collar connected thereto and a cover portion connected with the collar by means of a self-hinged portion.

OBJECTS OF THE INVENTION

It is an object of the invention to provide an improved packaging machine for packaging materials for disposal. It is a further object of the invention to simplify the design of such a vacuum packaging machine. It is a still further object of the invention to provide a vacuum packaging machine which allows the easy packaging of the material to be disposed without contamination of the environment. It is a further object of the invention to provide for a vacuum packaging machine for disposal of contaminated material.

SUMMARY OF THE INVENTION

In order to achieve the above-mentioned object the invention provides a vacuum packaging machine for the packaging of materials for disposal, comprising a container receiving a bag having an open top for entering the material, an openable lid for hermetically sealing the interior of said container from the exterior, means for evacuating the interior of said bag, means for fixing a cover for said bag on the inner side of said lid facing said bag and sealing means for welding said cover to said bag.

Further embodiments of the invention are defined in the dependent claims.

BRIEF DESCRIPTION OF THE DRAWINGS

Further advantages, features and objects of the invention will stand out from the following description of an examplary embodiment with reference to the drawings, wherein.

DESCRIPTION OF THE PREFERED EMBODIMENT

Figure 1:
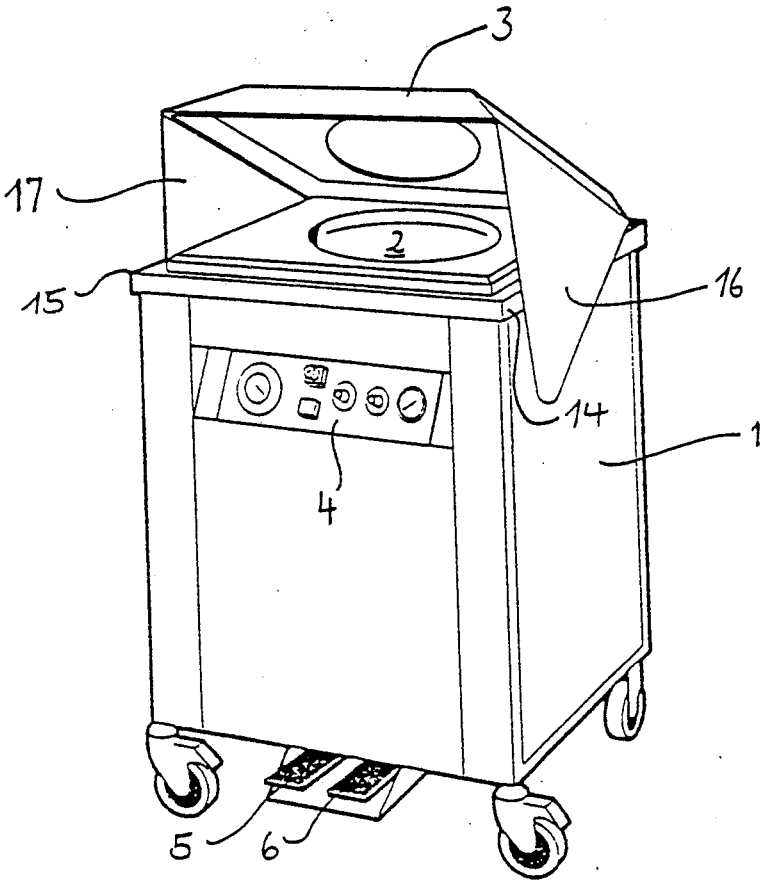
FIG. 1 is a general view of the machine in perspective representation having the lid partly opened.

The vacuum packaging machine is designed as a so-called chamber machine. It comprises a housing 1 including a chamber 2 for receiving a bag, a lid 3 for closing the chamber, an operating console 4 and foot switches 5, 6.

The chamber 2 is formed by a cylindrical container 7 extending substantially vertically downwards from the top of the housing and having a bottom closing the bottom side thereof. The opening of the chamber is surrounded by a ring 8. The lid 3 is pivotally connected with the housing 1 at a pivot axis 10 at the rear side 9 of the lid. Clamping or supporting bolts 11, 12 for receiving the rim of the bag are disposed on the surface facing the lid at the side of the ring facing the pivot axis 10 as well as on the opposite side of the ring corresponding to the opening side. The lid has also clamping bolts 13 arranged therein at the side opposite to the pivot axis 10, i.e. at the opening side of the lid.

The lid 3 has side walls 16, 17 extending parallel to the lateral edges 14, 15 of the upper side of the housing 1 and being disposed at the two sides of the lid 3 which extend transversely to the pivot axis 10. As may be best seen from FIGS. 1 and 2, the side walls are formed such that they laterally define or seal, resp., the space between the upper side of the chamber and the inner side of the lid when the lid is lifted up. The lid has a suction opening 19 being disposed at the opening side edge 18 opposite to the pivot axis and extending at the inner side of the lid transversely from one side of the opening to the other. The suction opening is connected through a hose 20 with a vacuum pump 21 which has the outlet thereof connected through a hose 22 with a filter 23. The outlet of the filter leads back into the interior of the housing. The housing and the associated lid are sealed such that the interior of the container is hermetically sealed from the exterior when the lid is closed.

A pneumatically operated piston means 25 which is formed as a piston cylinder means is disposed at the bottom side of the chamber 2. The cylinder is fixed within the housing. The piston extending into the chamber 2 at the bottom thereof comprises at the front side thereof a plate 26 extending substantially transversely to the direction of the axis of the cylinder-shaped chamber 2. The piston cylinder means is designed such that the plate is movable from the retracted position shown in FIG. 2 into the advanced position indicated in broken lines in FIG. 2.

The lid is held in closed position by means of the reduced pressure generated in the chamber. Further, not shown locking means may be provided which lock the lid in hermetically closed position. By operating the associated foot switch 5 the reduced pressure or the locking means is released and the lid is swung upwardly around an opening angle $\alpha$ of about 30 degrees relative to the bottom part by not shown means. The thereby obtained width of the opening allows to fill large material into the waste bag. By operating the other foot switch 6 the lid is swung upwardly by means of the not shown installation up to an angle $\beta$ of about 65 degrees relative to the bottom part such that the package containing the waste material may be easily removed.

Figure 8:
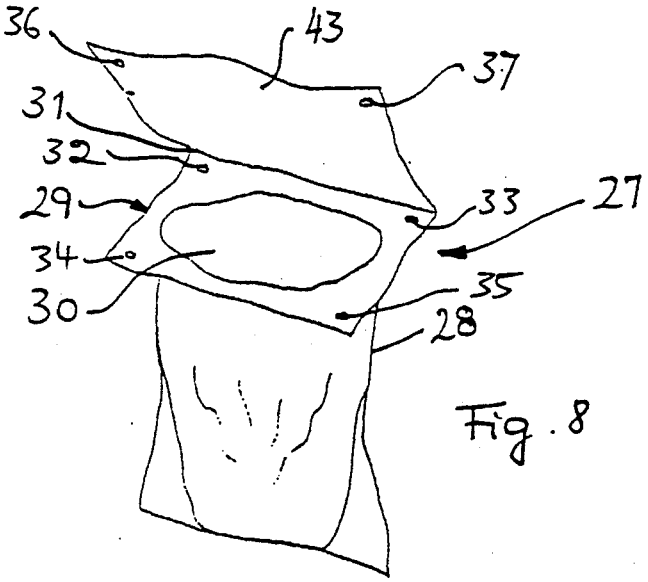
FIG. 8 is a bag to be used in the machine.

The prefered embodiment of the bag 27 used in connection with the machine is represented in FIG. 8. The actual bag portion 28 has a round edge and a rectangular collar 29 welded thereto. The collar 29 is a rectangular film or foil section having a circular opening 30. The collar 29 is rigidly connected or formed as a single part, resp., with a cover part 43 through a hinge portion or hinging edge 31. The cover part 43 can be folded down onto the opening and welded onto the collar. The collar has two opposite holes 32, 33 at the side thereof adjacent to the hinge portion 31 and further respective holes 34, 35 at the free side thereof opposite to the hinge portion. The cover part 43 has corresponding holes 36, 37 at its free edge opposite to the hinged edge. The geometric position of the holes 32 to 35 corresponds to the position of the clamping bolts 11 to 13.

Figure 6:
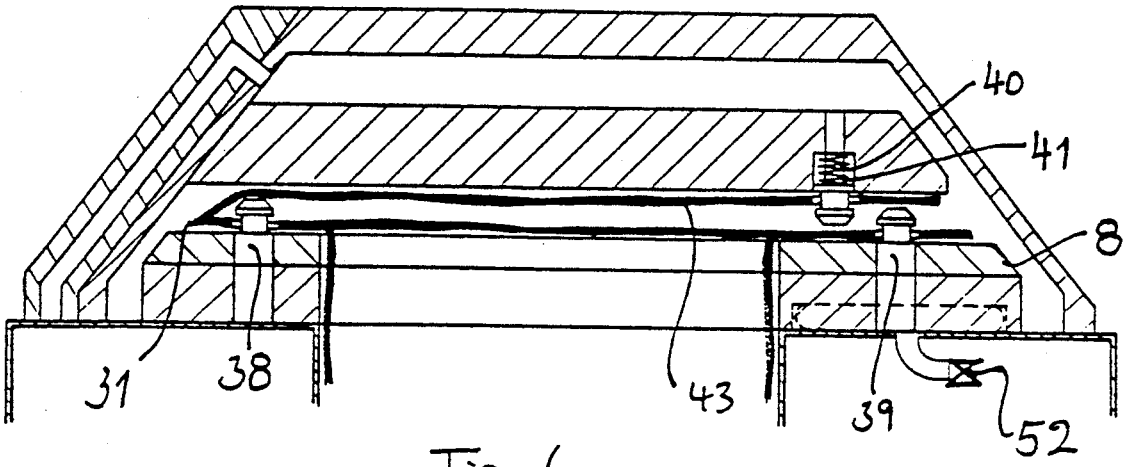
FIG. 6 is an enlarged section representing the mechanism for supporting the bag with closed lid.
Figure 7:
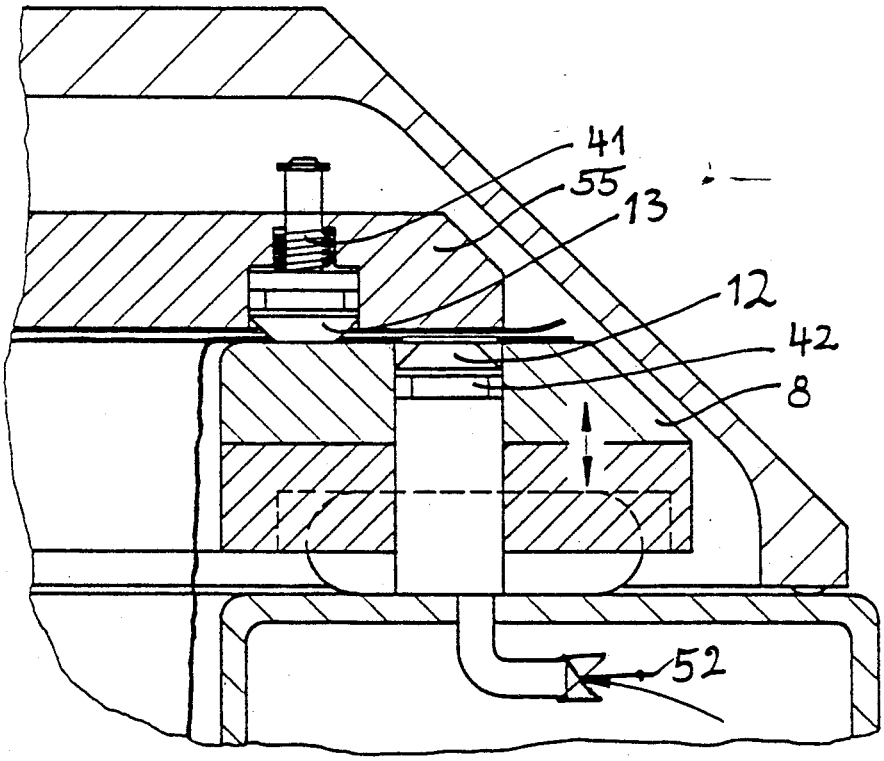
FIG. 7 is an enlarged representation of the mechanism for supporting the bag with closed chamber with the welding means being operated.

As may be best seen from FIGS. 6 and 7, the clamping bolts 11 to 13 are guided in associated bolt guides 38 to 40. The bolts 11, 12 supported in the ring 8 are fixed to the housing. The bolts 13 which are supported in portion 55 forming the inner side of the lid are biased into the position shown in FIG. 6 in which they protrude beyond the inner side of the lid, by means of respective compression springs 41 abutting the bottom of a closed ended hole. As best seen from FIG. 7, the head of the bolts has its outer end conically machined and a groove portion 42 with reduced diameter.

Figure 2:
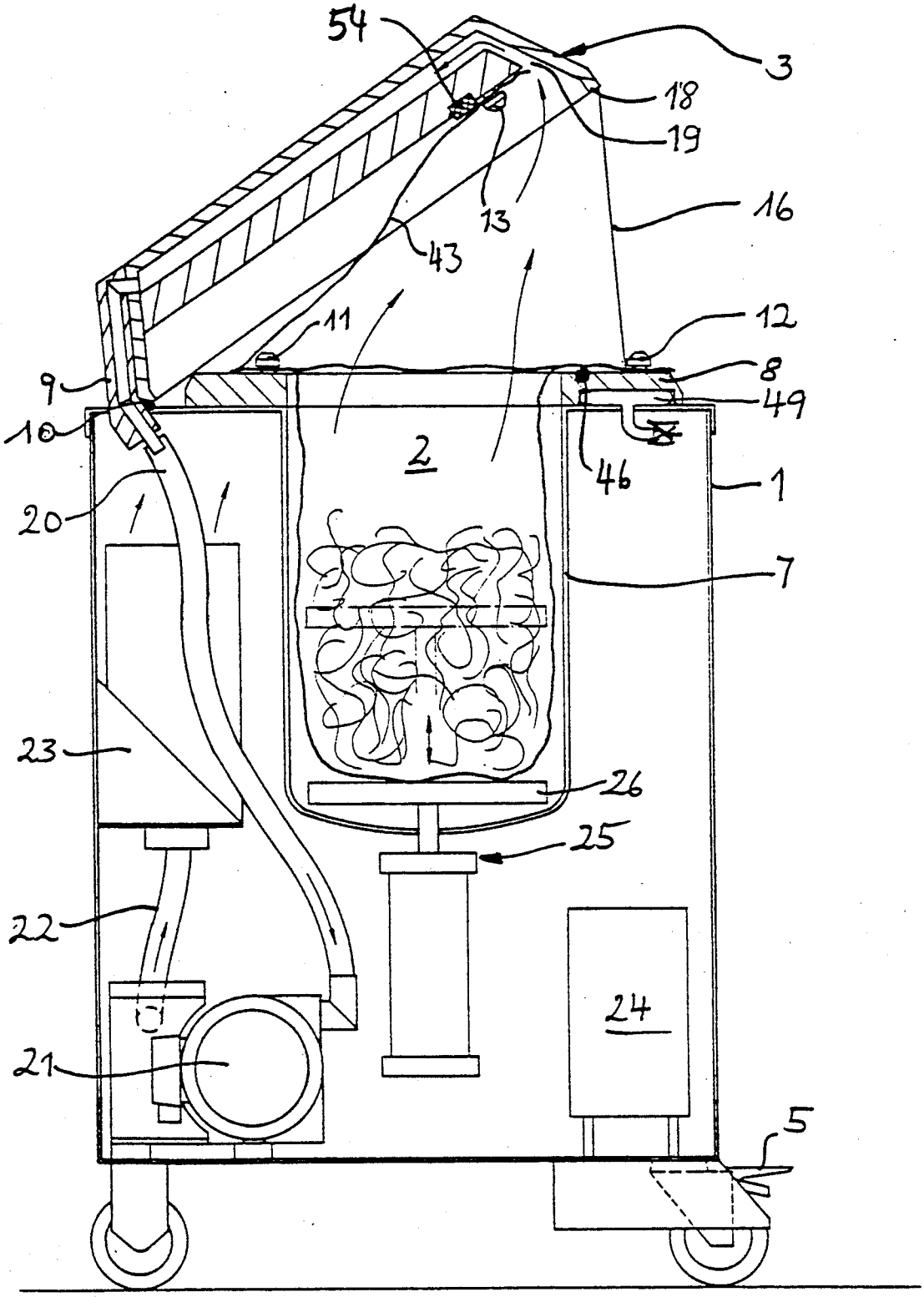
FIG. 2 is a vertical section through the apparatus shown in FIG. 1 with the partly opened lid.
Figure 3:
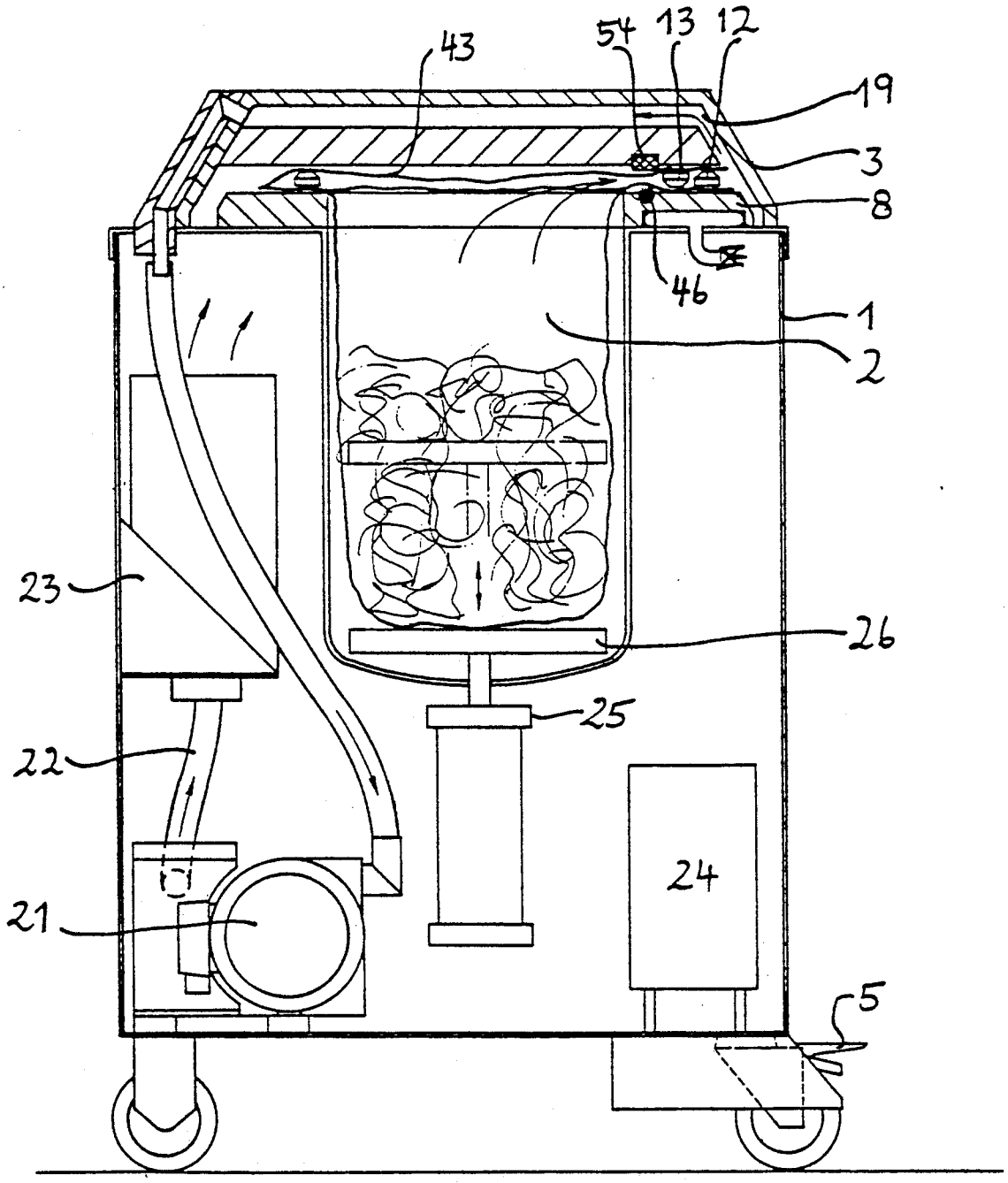
FIG. 3 is a representation corresponding to the one of FIG. 2 with closed lid.

In operation the bag portion 28 of the waste bag shown in FIG. 8 is inserted into the chamber 2 and the holes 32 to 37 of the collar and the cover portion are hooked to the associated bolts, as shown in the FIGS. 2, 3 and 6. It is thereby obtained that the bag is fixed in a position in the closed as well as the open state thereof and that the cover part 43 of the bag permanently fits close to the inner side of the lid opposite to the opening 30 of the bag portion and thereby prevents a contamination of this inner side.

Figure 4:
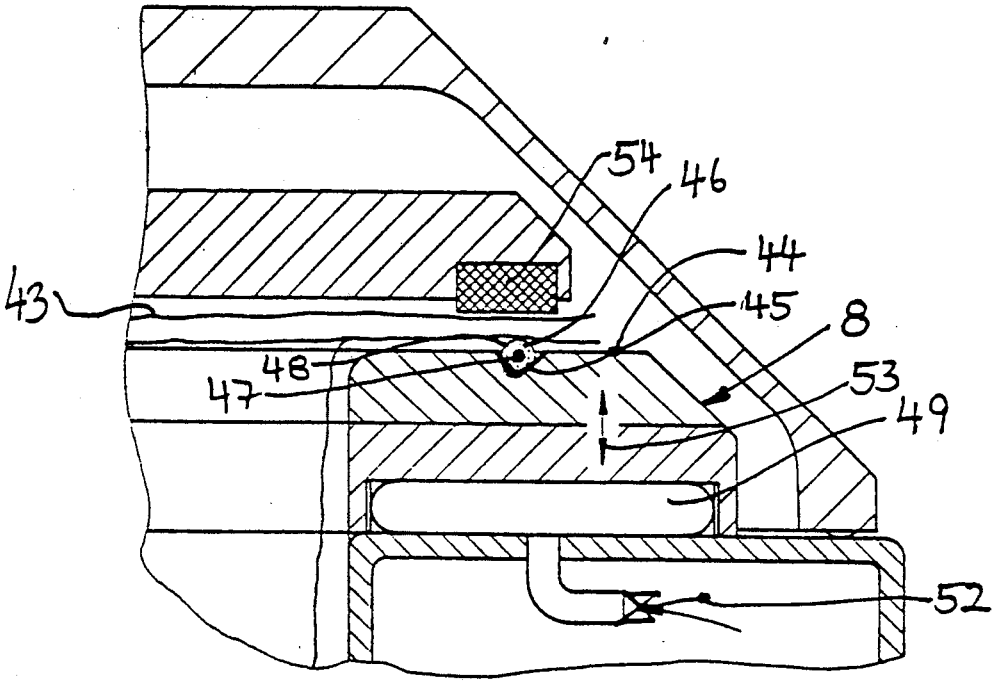
FIG. 4 is an enlarged sectional view of the welding means.
Figure 5:
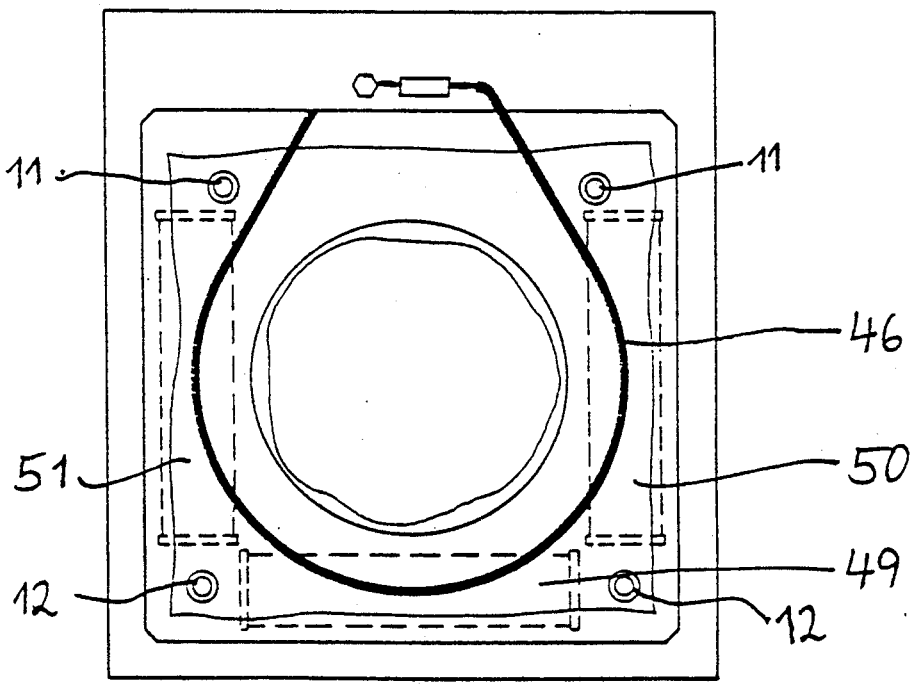
FIG. 5 is a top view of the machine having the lid removed.

The sealing means used for welding together those parts of the bag portion 28 or collar 29, resp., and of the cover part 43 which are not interconnected, is in particular represented in the FIGS. 4 and 5. The ring 8 has a groove 45 provided in the surface thereof facing the inner side of the lid, the contour of the groove corresponding to the desired sealing seam, as may be seen from FIG. 5. A heating installation 46 formed as a tubular heating body is provided in this groove. The resistance element 47 of the heating installation is provided in an insulated manner within a thin metal tube 48 having an overall thickness of about 4 mm. The tubular heating body is held in the groove by means of conical disks and may radially as well as axially expand when heated. No clamping device as conventionally used for welding with pulse bands is therefore required.

As shown in FIG. 4, flexible diaphragms or tubes 49 to 51 are disposed at the bottom side of the ring 8 such that by operating the diaphragms through a compressed air source 52 the ring 8 is lifted in direction of arrow 53 from the lowered position shown in the FIGS. 3, 4 and 6 into the sealing position shown in FIG. 7. An elastomeric abutment 54 is provided at the inner side of the lid opposite to the tubular heating installation 46.

Whenever the ring 8 is moved from the lowered position shown in FIG. 6 into the raised position shown in FIG. 7, the tubular heating installation 46 and the abutment 54 cooperate for welding together the collar 29 and the cover part 43 of the bag. Furthermore, the heads of the fixing or clamping bolts 13 are pushed back into the bolt guides in the manner shown in FIG. 7. At the same time the ring 8 slides upwardly relative to the bolts 11, 12 such that these disappear within the bolt guides. In this manner the collar is pushed off from the bolts.

The control 24 is connected on the one hand with the operating console 4 and the foot switches 5, 6 and on the other hand with the vacuum pump 21, the means releasing the opening position of the lid, the sealing means, the piston means and the locking means, if available.

In operation, the packaging machine being in the open state as shown in FIG. 1, the bag is first inserted such that the edge connecting the collar and the cover part extends substantially parallel to the rear pivot axis 10, as may be best seen from FIG. 2. The holes 32 to 37 are fit to the fixing bolts. Owing to the fact that the collar is fixed to the bottom part the formation of creases when filling the bag is avoided as far as possible. Also the collar of the bag is prevented from slipping during the filling operation until the welding of the waste bag has been performed. After insertion of the material to be packaged, the lid is closed.

The control is designed such that the interior of the housing and the chamber and therefore in particular the interior of the bag is evacuated down to a predetermined pressure of preferably about 700 mbar when the lid is closed. The evacuation by means of vacuum pump 21 prevents gases from exiting from the materials to be packaged. The predetermined reduced pressure is maintained by a corresponding control when the lid is closed and is restored after each intermediate filling operation.

The lock of the lid 3 is released by operating the foot switch 5 for filling in further material. Simultaneously the suction at suction opening 19 is initiated such that the air above the open bag is exhausted. By this means the operator can not come into contact with contaminated suspension parts and gases and nothing enters the environment, when the lid is open.

After finishing the filling operation the lid closes automatically as soon as the foot switch is released. The atmosphere in the interior of the chamber and bag is then evacuated to the predetermined value in the above described manner.

The removal of the bag is initiated by operating the foot switch 6. In a first step the evacuation is first continued down to a predetermined set value in order to have the desired vacuum within the bag, the ring 8 is lifted by means of the flexible rubber diaphragms 49 to 51 and a seal is made by the sealing means 46 to 48. The interior of the chamber is first aerated before opening the lid. The piston means 25 is controlled such that the bag is compressed by the plate 26 before or during the aeration in order to reduce the volume thereof and to obtain a desired compact form. Thereupon the lid may be opened. The lid is then opened, in the present case with the vacuum pump being switched off, and the finished sealed package can be removed and replaced by a new bag to be inserted.

While the invention has been described in prefered form it is not limited to the precise nature shown as various modifications may be made without departing from the scope of the appended claims.

What is claimed is:

1. Vacuum packaging machine for the packaging of materials for disposal, comprising a container chamber receiving a bag having an open top for entering the material, an openable lid for hermetically sealing the interior of said container chamber from the exterior, means for evacuating the interior of said bag, means for fixing a cover for said bag on the inner side of said lid facing said bag, and sealing means for welding said cover to said bag.

2. The vacuum packaging machine of claim 1, comprising means for fixedly clamping the edge of said bag and/or said cover, said clamping means being disposed at the edge surrounding said container chamber and/or at the inner side of said lid.

3. The vacuum packaging machine of claim 2, wherein said clamping means are formed as bolts which are inserted into holes provided in the edge or the inner side of the lid, resp., and which project beyond said edge or said inner side, resp., in open position of said lid and which are in a bag release position after said welding process.

4. The vacuum packaging machine of claim 1, comprising a suction opening which is provided at the inner side of said lid and which is connected to said evacuation means.

5. The vacuum packaging machine of claim 1, comprising a pivot axis for pivoting said lid into a filling position or opening and lateral covers for covering the sides between said lid and said container chamber in open position of said lid.

6. The vacuum packaging machine of claim 1, comprising a control unit for operating said evacuation means and said sealing means.

7. The vacuum packaging machine of claim 6, comprising a lid locking means connected with said control unit and preselection switches for selecting the mode of operation, said switches being also connected to the control unit.

8. The vacuum packaging machine of claim 7, wherein in a preselected "filling" operation the control unit activates a pivot action of said lid around a preselected angle $\alpha$ into the open position and simultaneously switches on said means for evacuating through said suction opening.

9. The vacuum packaging machine of claim 7, wherein in a preselected "remove package" operation the control unit evacuates the interior of said bag, said sealing means welds or seals said cover to said bag when a preselected reduced pressure has been obtained, and thereafter said lid is activated to be pivoted around a preselected angle $\beta$ up to a bag withdrawing position.

10. The vacuum packaging machine of claim 1, said container chamber being maintained at a predetermined vacuum when said lid is in closed position.

11. The vacuum packaging machine of claim 1, wherein said sealing means comprises a tubular heating body disposed in a groove corresponding to the desired sealing contour, said tubular heating body having a resistance member mounted within a metal tube in an insulated manner.

12. The vacuum packaging machine of claim 1, comprising piston means arranged in the bottom portion of said container chamber, said piston means operating to press in a direction towards said lid which is still in locked state for compressing said bag.

13. A bag for use in the vacuum packaging machine of claim 1, comprising a bag portion having an edge, a collar welded thereto, a cover part connected with said collar through a hinge portion and holes provided in said collar and said cover part for hanging said bag to said bag clamping or fixing means.

14. The vacuum packaging machine of claim 12, including means for aerating said chamber wherein said piston means is controlled to operate before or during an aeration by said aerating means.

* * * * *